United States Patent [19]

Aymes

[11] Patent Number: 4,997,061

[45] Date of Patent: Mar. 5, 1991

[54] LADDER ASSEMBLY, PARTICULARLY FOR USE WITH SWIMMING POOLS

[76] Inventor: Doniel G. Aymes, P.O. Box 1783, New Brunswick, N.J. 08902

[21] Appl. No.: 391,318

[22] Filed: Aug. 8, 1989

[51] Int. Cl.[5] ..... E06C 1/28; E06C 1/38

[52] U.S. Cl. ..... 182/106; 182/46; 182/118; 182/194

[58] Field of Search ..... 182/106, 151, 117, 118, 182/119, 46, 194

[56] References Cited

U.S. PATENT DOCUMENTS

| | | | |
|---|---|---|---|
| 2,382,370 | 8/1945 | Tully | 182/106 |
| 2,448,264 | 8/1948 | Jung . | |
| 2,944,625 | 7/1960 | Shore | 182/106 |
| 2,962,112 | 11/1960 | Ramsberger et al. . | |
| 2,996,729 | 8/1961 | Bailey | 182/106 |
| 3,029,897 | 4/1962 | Moberg . | |
| 3,288,248 | 11/1966 | Gurian et al. . | |
| 3,428,146 | 2/1969 | Bair . | |
| 3,447,633 | 6/1969 | Montalto . | |
| 3,487,889 | 1/1970 | Horowitz et al. . | |
| 3,566,992 | 3/1971 | Berger . | |
| 3,908,795 | 9/1975 | Gannon . | |
| 3,964,572 | 6/1976 | Gannon . | |
| 3,994,479 | 11/1976 | Johannesson . | |
| 4,004,652 | 1/1977 | Alvarado | 182/118 |
| 4,023,647 | 5/1977 | Confer . | |
| 4,303,226 | 12/1981 | Powell et al. . | |
| 4,527,297 | 7/1985 | Pettit . | |
| 4,603,758 | 8/1986 | Pettit . | |

*Primary Examiner*—Reinaldo P. Machado
*Attorney, Agent, or Firm*—R. Neil Sudol; Henry D. Coleman

[57] ABSTRACT

An A-frame ladder comprises two side rail assemblies and a platform guard rail assembly each provided in their rail members with elongate oval apertures defining handholds or hand grips. Steps of the side rail assemblies and the platform of the platform guard rail assembly are formed with elongate openings for draining water from the upper surfaces of the steps and the platform and for augmenting the gripping of users' feet by those upper surfaces. The steps are connected to the side rails by snap lock pins and the side rail assemblies are connected to guard rail members of the platform guard rail assembly by twist-ock pins, whereby an outer side rail assembly may be removably disconnected from the platform to prevent access to a swimming pool by youngsters. Brackets are attachable to the guard rail members of the platform guard rail assembly for connecting the platform guard rail assembly to sections of a perimetrally extending fence, whereby the ladder becomes an integral part of the fence. The A-frame ladder may be separated into two sections, namely, an in-pool ladder and a staircase ladder, for use with a pool deck.

33 Claims, 12 Drawing Sheets

LADDER ASSEMBLY, PARTICULARLY FOR USE WITH SWIMMING POOLS

BACKGROUND OF THE INVENTIQN

This invention to relates a ladder assembly. More particularly, this invention relates to a ladder assembly for use with swimmming pools.

A swimming pool, particularly an above-ground pool, is generally provided with a ladder for enabling access to the pool, the ladder including a plurality of steps extending between a pair of side rails. Some swimming pool ladders take the form of staircase ladders each of which essentially consists of a pair of linear side rails supporting a plurality of spaced steps. Other swimming pool ladders take the form of A-frames which include two oppositely inclined pairs of parallel side rails to which several steps are fastened. At the apex of the A-frame is a platform.

U.S. Pat. No. 2,962,112 to Ramsberger et al., U.S. Pat. No. 3,288,248 to Gurian et al., U.S. Pat. No. 3,428,146 to Bair, U.S. Pat. No. 3,447,638 to Montalto, U.S. Pat. No. 3,908,795 to Gannon, and U.S. Pat. No. 4,023,647 to Confer all disclose A-frame sWimming pool ladders.

Ramsberger et al. is directed to an A-frame ladder having one side which is cantilevered, i.e., supported from the platform of the ladder. The ladder is made of wood and the steps are fastened to ladder side rails via screws.

Gurian et al. shows a swimming pool ladder having an outer staircase section (outside a pool) which is pivotably or slidably fixed to an A-shaped frame to enable temporary removal of the steps outside the pool, thereby limiting or preventing pool access, during periods when the pool is not in use.

Montalto describes an A-frame swimming pool ladder with a platform which is tiltably connected to the side rails disposed outside a swimming pool. The platform is biased towards an inoperative orientation parallel to the outer side rails by an automatic actuator and may be locked in that non-use position by a pawl.

Gannon depicts a swimming pool safety ladder which includes an outer ladder section both removably and pivotably attached to an in-pool ladder section at the platform thereof. The connection between the two ladder sections is implemented by pins provided with U-shaped clips. Similar locking pins are disclosed in another patent to Gannon, namely, U.S. Pat. No. 3,942,572.

Confer relates to an A-frame ladder having a generally hollow structure formed by a blow molding technique. The ladder members are attached to respective base members in snap-lock fits.

Bair discloses a ladder structure with a slidably movable outer section similar to a ladder of Gurian et al.

Besides supporting the steps and defining the frame of a ladder, the side rails frequently perform the additional function of serving as handholds for a person using the ladder. In that case the side rails are also handrails. In other cases, separate bars are attached to the side rails to serve as handholds and handrails. In addition, most A-frame ladders include separate guard rails, which also serve as handrails, disposed at the top of the ladder, on opposite sides of the platform. See, for example, Ramsberger et al., Gurian et al., Bair, Montalto, Gannon, and Confer.

Generally, swimming pool ladders must be constructed or assembled on site. The assembly is accomplished either by the swimming pool owner, with some effort and aggravation owing to the number of parts and the difficulty of assembly, or by a hired installer. In the latter case, the cost of assembling the ladder may amount to more than the cost of the ladder prior to on-site assembly.

OBJECTS OF THE INVENTION

An object of the present invention is to provide a ladder assembly, particularly but not exclusively for use with swimming pools, which is easy to assemble on site.

Another object of the present invention is to provide such a ladder which is easy to fabricate.

A further object of the present invention is to provide a such a ladder assembly which includes handholds usable by the elderly and small children, as well as by normal adults.

Yet another object of the present invention is to provide a swimming pool ladder assembly which presents a reduced chance of slippage, i.e., which has foot gripping or non-slip surfaces.

Another, particular, object of the present invention is to provide a ladder assembly which is utilizable with a swimming pool deck and, alternatively, as an A-frame ladder.

Yet another particular object of the present invention is to provide a swimming pool ladder assembly which is easily integrated into an entire swimming pool system.

An even more specific object of the present invention is to provide such a swimming pool ladder assembly which is easily integrated with a swimming pool fence extending perimetrally around a pool, whether round, oval, rectangular or polygonal.

Another object of the present invention is to provide a swimming pool ladder assembly which includes a separable staircase section removably attached by improved means to an in-pool section of an A-frame ladder.

SUMMARY OF THE INVENTION

An A-frame ladder assembly in accordance with the present invention comprises a pair of first side rails, a pair of second side rails, a plurality of first steps disposed between and connected to the first side rails, a plurality of second steps disposed between and connected to the second side rails, a platform connected to the side rails at upper ends thereof, and a pair of platform guard rails connected to the platform, the side rails and the guard rails being provided with integral handholds.

Pursuant to another feature of the present invention, the side rails and the guard rails are formed with elongate apertures arranged in linear arrays to define and form the hand holds.

Pursuant to a further feature of the present invention, a pair of the side rails and the associated steps form a removable staircase section, the ladder further comprising attachment elements for removably attaching the staircase section to the platform. Preferably, the attachment elements include interlocking projections and recesses on the platform and an uppermost one of the steps of the staircase section, the projections taking the form of flattened wings on the platform.

In a more general embodiment of the present invention, a ladder comprises a pair of side rails each formed, along at least a portion of their respective lengths, with respective integrally formed hand holds, and a plurality of steps extending between the side rails.

In accordance with an additional feature of the present invention, the ladder takes the form of a staircase ladder, further comprising attachment devices for connecting the ladder at an upper end alternatively to a swimming pool deck or a platform of an in-pool ladder section, thereby forming an A-frame ladder.

In accordance with further features of the present invention, the attachment devices serve to removably connect the ladder to a platform portion of an in-pool ladder section to form an A-frame ladder and comprise mating projections and recesses on the platform portion of the in-pool ladder section and an uppermost step of the staircase ladder.

As discussed hereinabove, the side rails may be provided with respective apertures defining the handholds. Preferably, the apertures are elongated and disposed in linear arrays to define the handholds.

In accordance with yet another feature of the present invention, the steps are each provided with a plurality of apertures to form foot gripping or slip resistant surfaces.

Pursuant to a concomitant embodiment of the present invention, a ladder assembly disposable inside a swimming pool for enabling climbing access to and from the pool comprises a pair of side rails integrally formed, along at least a portion of their respective lengths, with respective hand holds. A plurality of steps extends between the side rails, while a platform is connected to the side rails at upper ends thereof. A pair of platform guard rails are connected to the platform and the side rails at the upper ends thereof, the guard rails being integrally formed, along at least a portion of their respective lengths, with respective hand holds.

Each of the side rails is advantageously provided with a plurality of elongate apertures disposed in linear arrays to define the handholds on the side rails.

In accordance with an additional feature of the present invention, attachment components are provided for connecting the ladder assembly alternatively to a swimming pool deck and a staircase ladder section. The attachment components desirably include means for removably connecting the ladder assembly to a staircase ladder section to form an A-frame ladder assembly.

Pursuant to further features of the present invention, the steps and the platform are provided with respective pluralities of apertures in substantially rectangular arrays to form foot gripping or slip resistant surfaces, while the platform guard rails are provided with means for decreasing pass through potential, i.e., open air spacing, of the guard rails. Preferably, the guard rails are formed to provide a 60% sight barrier.

In accordance with a particular embodiment of the present invention, the platform guard rails each include an upper portion in the general form of a downwardly facing C and a pair of leg portions diverging from the upper portion. In that case, the means for decreasing the pass through potential (open air spacing) of the guard rails includes a first cross-piece extending horizontally between lower ends of the upper portion and a second cross-piece extending vertically from a central uppermost point of the upper portion.

In another particular embodiment of the present invention, an A-frame ladder for enabling access to a swimming pool comprises a staircase section, including an uppermost step, an in-pool section including a platform, and attachment elements for removably connecting the staircase section an an upper end thereof to the in-pool section at the platform, the attachment elements including a pair of rotatable pins each provided at one end with an outwardly radially projecting flange having a circumferential extent of less than 360°.

As discussed hereinabove, the attachment elements may additionally include substantially planar projections on the platform and mating recesses on the uppermost step.

In accordance with another feature of the present invention, a bracket may be provided for connecting the ladder to a perimetrally extending swimming pool fence.

In yet another particular embodiment of the present invention, an A-frame ladder for enabling access to a swimming pool comprises a staircase section, including an uppermost step, an in-pool section including a platform, attachment elements for removably connecting the staircase section at an upper end thereof to the in-pool section at the platform, and stabilizing components for stabilizing and strengthening the connection of the staircase section to the in-pool section.

A plurality of brackets may be provided for connecting a fence section between the platform guard rails to secure and limit entry into the pool, particularly for unsupervised, uninvited and unattended persons. One may elect to insert a section of fence between the platform guard rails with brackets identical to the brackets provided for connecting the ladder on the outer sides of its platform guard rails to a perimetrally extending swimming pool fence. Thus, connector brackets are advantageously fastened to the inside and outside of or through the A-frame ladder for receiving the free ends of horizontal support bars of an auxiliary fence section specifically made to fit into the opening between the platform guard rails, whereby the auxiliary fence section becomes an integral part of the ladder and the fence extending around the perimeter of the pool.

A swimming pool assembly according to the present invention comprises a pool bottom, a pool sidewall connected in the manner of a hoop to itself to form a pool enclosure, and a top rail member mounted to the sidewall. The top rail member includes a planar main body portion disposed in a substantially horizontal orientation in an installed condition of the top rail member. A ladder is provided for accessing the pool enclosure, the ladder having a multiplicity of steps. The main body portion of the top rail and the steps are each provided with a multiplicity of apertures arranged in a rectangular array, the apertures having a common size and shape. In accordance with a specific aspect of the present invention, the top rail member constitutes a portion of a walk around deck of the swimming pool assembly.

The apertures in the main body portion of the top rail member and in the steps of the swimming pool ladder serve in part to facilitate drainage of water from upper surfaces and in part for enhancing a gripping capability of those upper foot gripping or slip resistant surfaces.

A ladder in accordance with yet another specific embodiment of the present invention comprises a pair of side rails, a plurality of steps extending between the side rails, and a pair of snap lock pins connecting each of the steps to the side rails, the snap lock pins extending perpendicularly to and through the respective step. Advantageously, a spreader bar is provided with a pair of spaced receptacles receiving bottom ends of the side rails, additional snap lock pins connecting the side rails to the spreader bar at the receptacles.

A ladder assembly in accordance with the present invention is easy to assemble on site. The steps fit easily into receiving brackets in the side rails and are simply attached thereto by snap lock pins. In addition, the ladder assembly is easy to fabricate. It is preferably made by injection molding of polymer resin.

An advantage of the invention is the provision of integral handholds in the ladder side rails and platform guard rails. The handholds or handrails require no separate installation and are usable by the elderly and small children, as well as by normal adults.

Further advantages of the present invention, especially where used in swimming pool applications, include a reduced chance of slippage, owing to the formation of apertures in the horizontal, load bearing surfaces of steps, platforms and the pool top rails.

A ladder assembly pursuant to the present invention can be used as an A-frame ladder or can be partially disassembled and used as two separate ladders connectable at different locations to a pool deck.

By virtue of the connecting brackets for securing the A-frame ladder to a swimming pool fence, and in view of the similarity in design between the ladder steps and platform and the pool top rail, a swimming pool ladder assembly in accordance with the invention is easily integrated into an entire swimming pool system.

DETAILED DESCRIPTION

Figure 1:
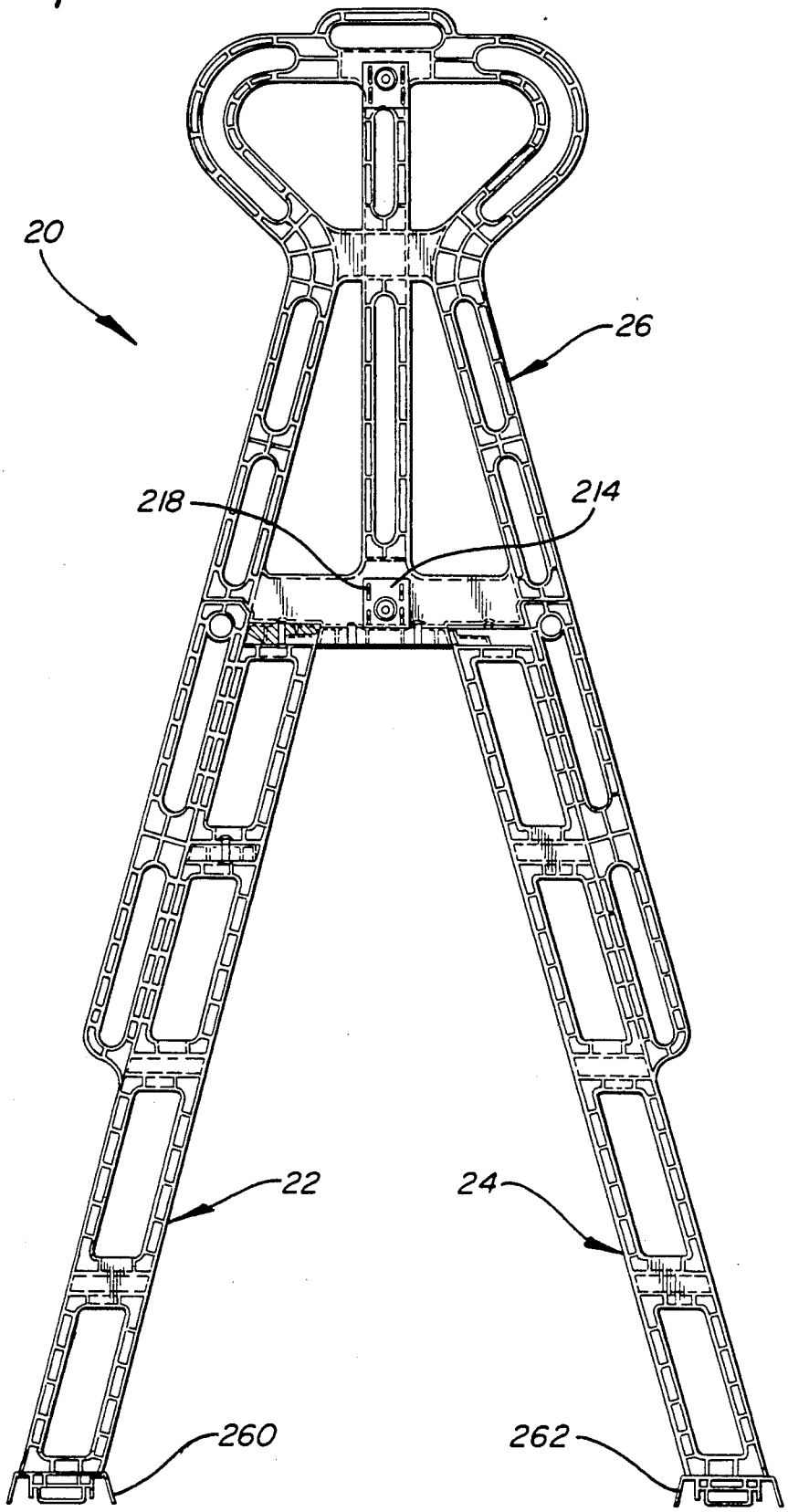
FIG. 1 is a side elevational view of an A-frame ladder in accordance with the present invention.
Figure 2:
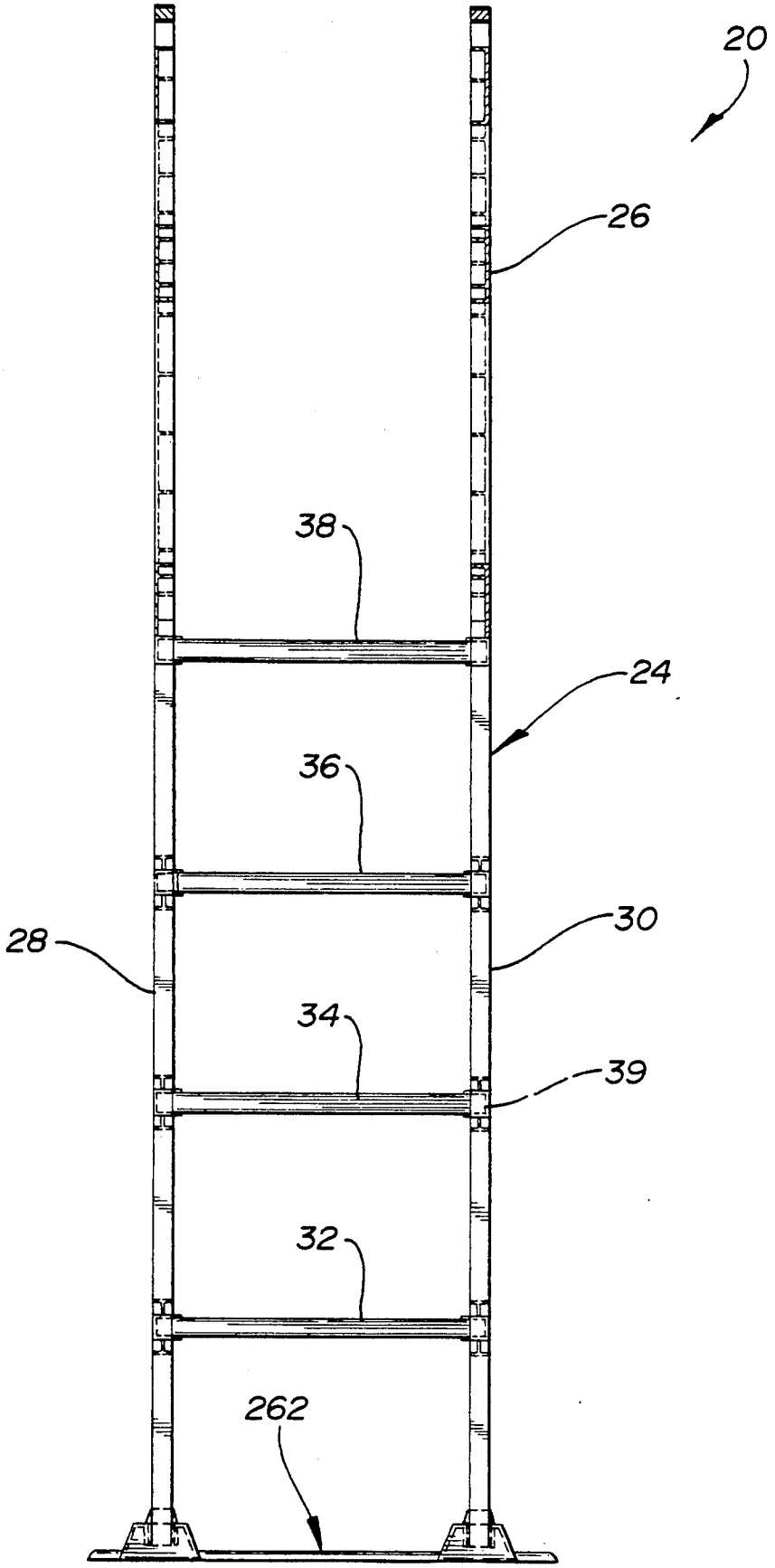
FIG. 2 is a front elevational view of the ladder of FIG. 1.
Figure 11:
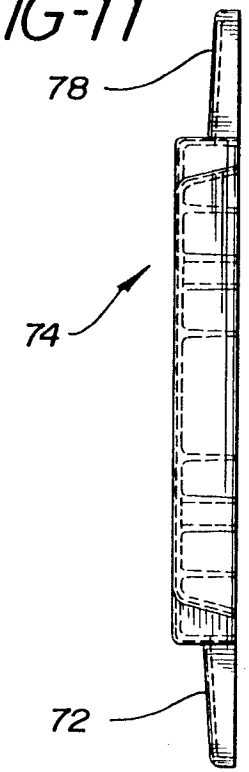
FIG. 11 is a side elevational view of the platform of FIG. 10.
Figure 10:
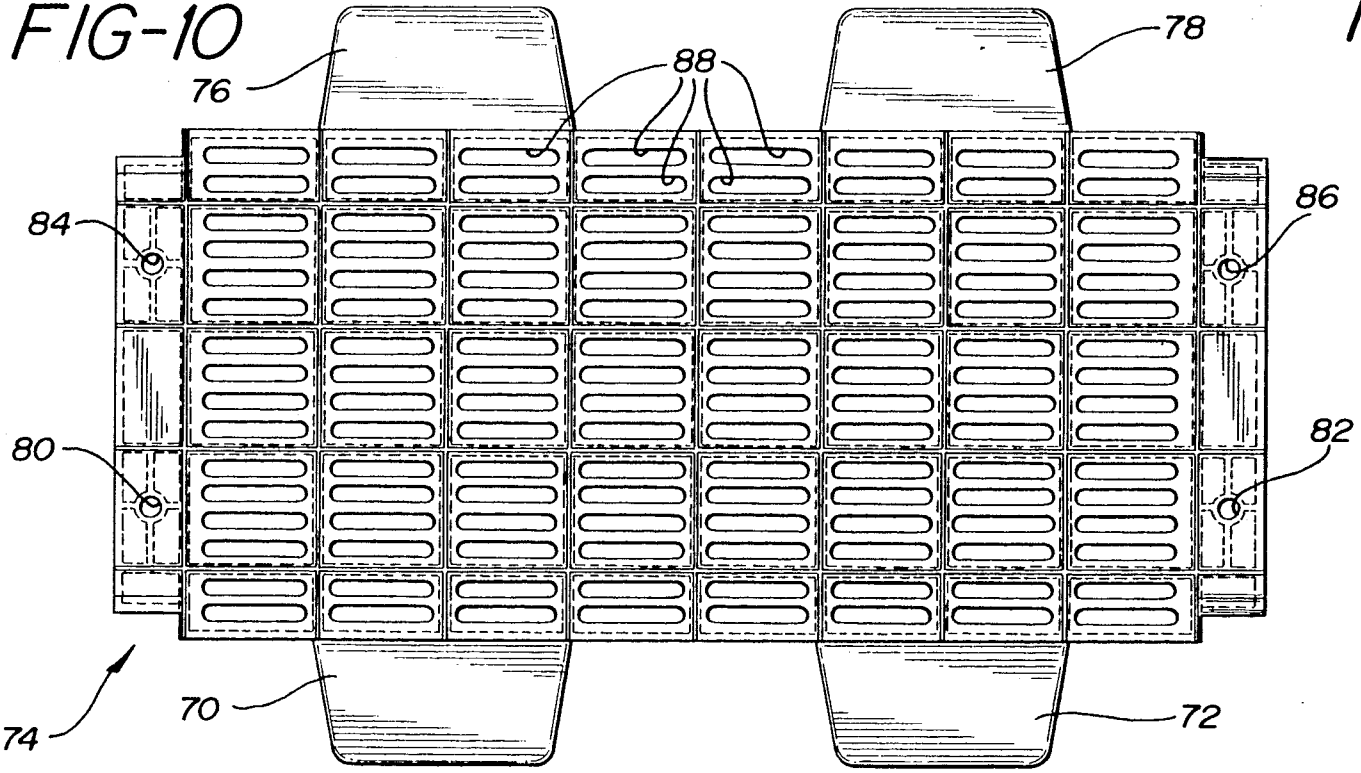
FIG. 10 is a top view of a platform in the ladder of FIGS. 1 and 2.
Figure 12:
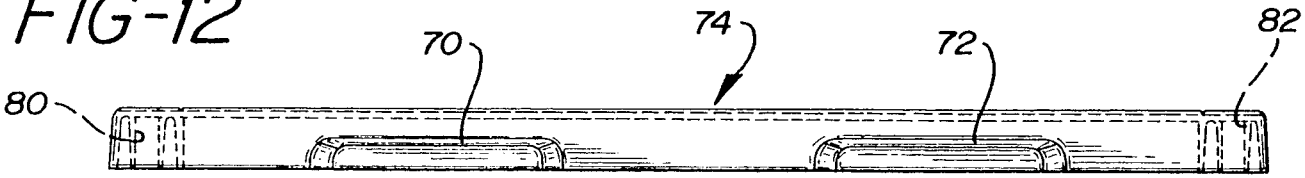
FIG. 12 is a front elevational view of the platform of FIGS. 10 and 11.
Figure 21:
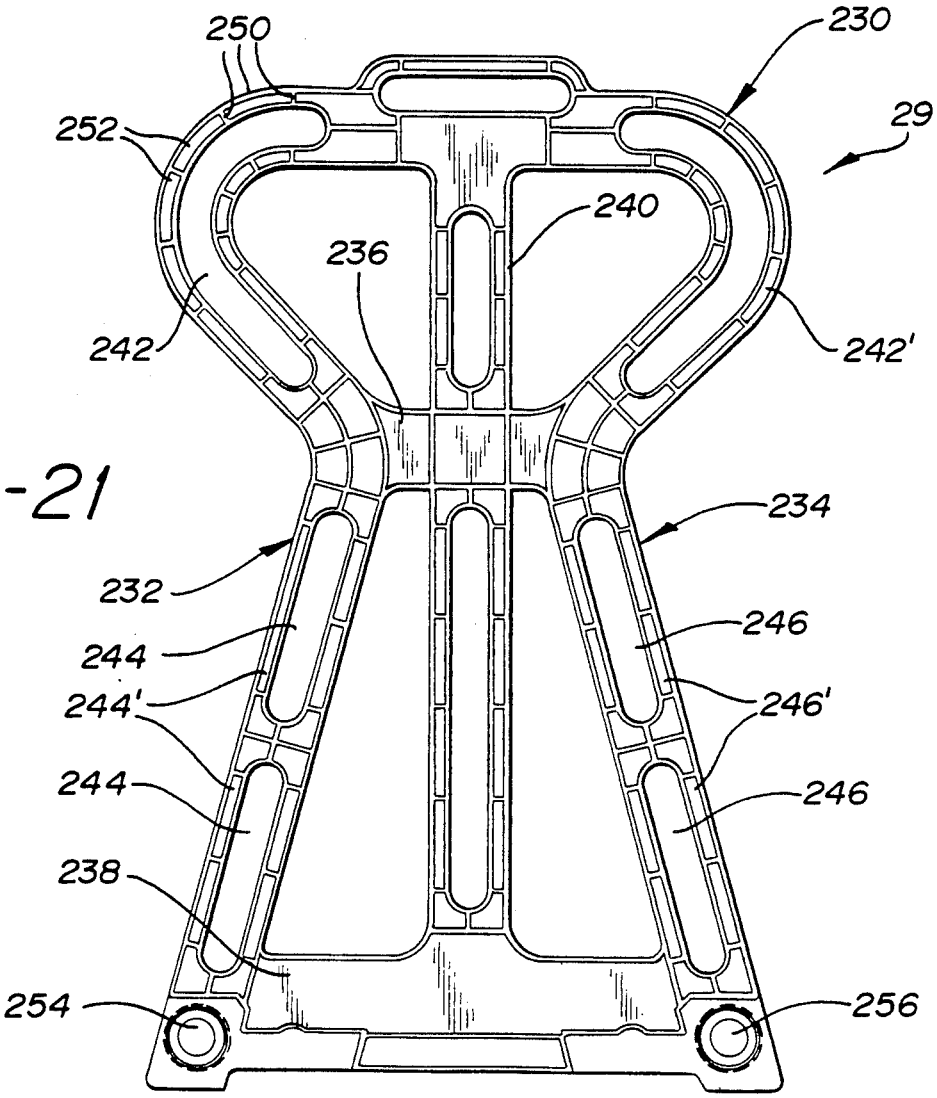
FIG. 21 is a side elevational view, on an enlarged scale, of a platform guard rail member shown as a portion of the A-frame ladder of FIGS. 1 and 2.

FIGS. 1 and 2 are side and front elevational views, respectively, of an A-frame ladder 20 included in a particular embodiment of the invention. Ladder 20 comprises three basic components, namely, two side rail assemblies 22 and 24 and a platform guard rail assembly 26. Vertical support members 28 and 30 of side rail assemblies 22 and 24 are shown separately in FIGS. 3 and 4, respectively, while a platform 74 of platform guard rail assembly 26 is illustrated in FIGS. 10, 11 and 12 and a guard rail member 29 of the guard rail assembly is depicted in FIG. 21.

Each side rail assembly 22 and 24 includes a pair of substantially vertical support members 28 and 30 (see FIG. 2), three lower steps 32, 34 and 36 and a top step 38. Each step 32, 34, 36 and 38 is fastened at its opposite ends to vertical support members 28 and 30 via pairs of snap-lock pins 40 illustrated in side elevational and front elevational view in FIGS. 5 and 6, respectively. As shown in FIG. 2, steps 32, 34, 36 and 38 are received in respective C-shaped channel segments or brackets 39 attached to or integrally formed with vertical support members 28 and 30. Snap-lock pins 40 extend perpendicularly with respect to steps 32, 34, 36 and 38 and parallel to vertical side rail support members 28 and 30.

Ladder 20 and the components of various assemblies included therein ar preferably formed of polymeric resin material by injection molding techniques. As described in greater detail hereinafter, vertical support members 28 and 30 of side rail assemblies 22 and 24 have a web and flange microstructure which maximizes strength while concomitantly minimizing weight and material use. In addition, such a microstructure is easy to manufacture by injection molding.

Figure 5:
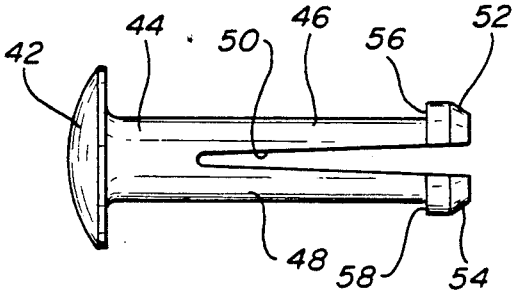
FIG. 5 is a side elevational view of a snap-lock pin, on an enlarged scale, used to fasten steps to side rails in the staircase subassemblies of FIGS. 3 and 4.
Figure 6:
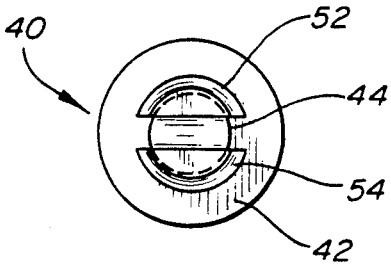
FIG. 6 is an end or front elevational view of the snaplock pin of FIG. 5.

As depicted in FIGS. 5 and 6, a snap-lock pin 40 includes a rounded head 42 and a cylindrical shaft 44 coaxial therewith. Shaft 44 is divided at a free end into a pair of prongs 46 and 48 by a tapered recess 50. At their free ends, prongs 46 and 48 are provided with respective, outwardly extending flanges 52 and 54 which define shoulders 56 and 58 engageable with a horizontal surface of a C-shaped brackets 39 in vertical support members 28 and 30 upon insertion of the snap-lock pin 40 through a hole in a step 32, 34, 36 or 38 and through a registering hole in the respective C-shaped bracket 39.

Figure 7:
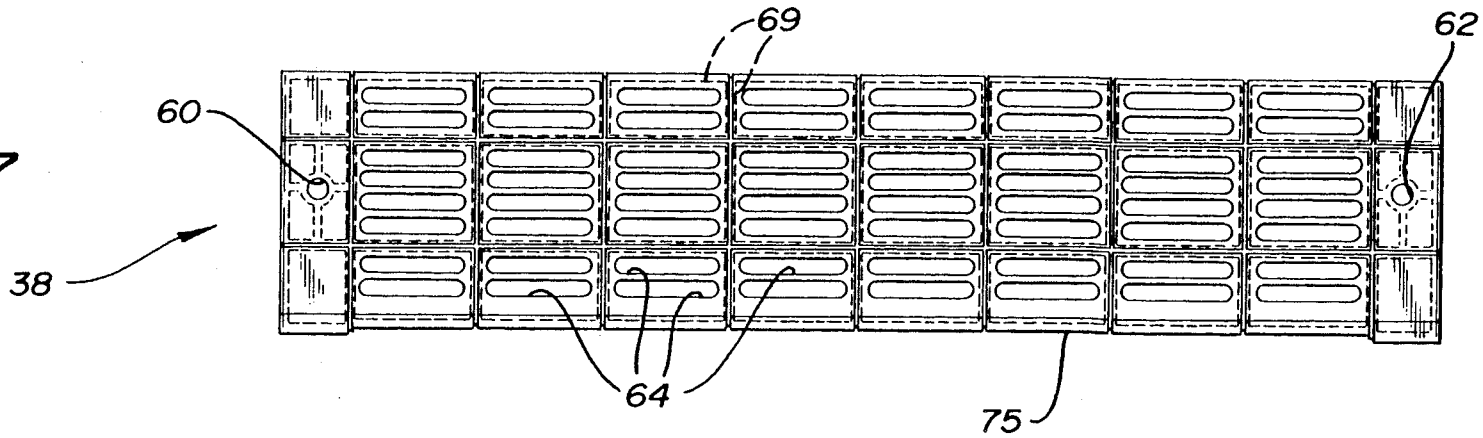
FIG. 7 is a top view of a top step in either of the staircase assemblies of FIGS. 3 and 4.
Figure 8:
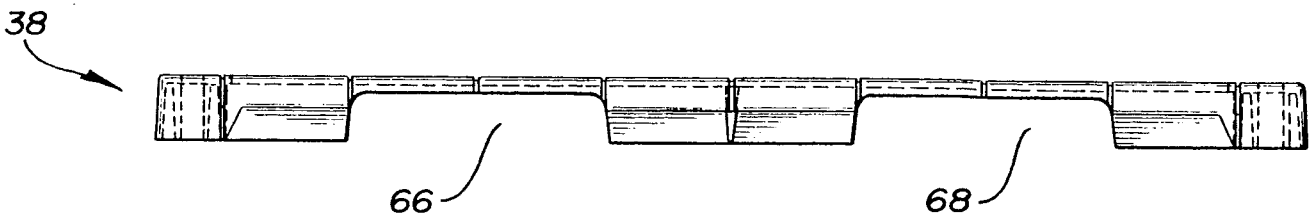
FIG. 8 is a rear elevational view of the top step of FIG. 7.
Figure 9:
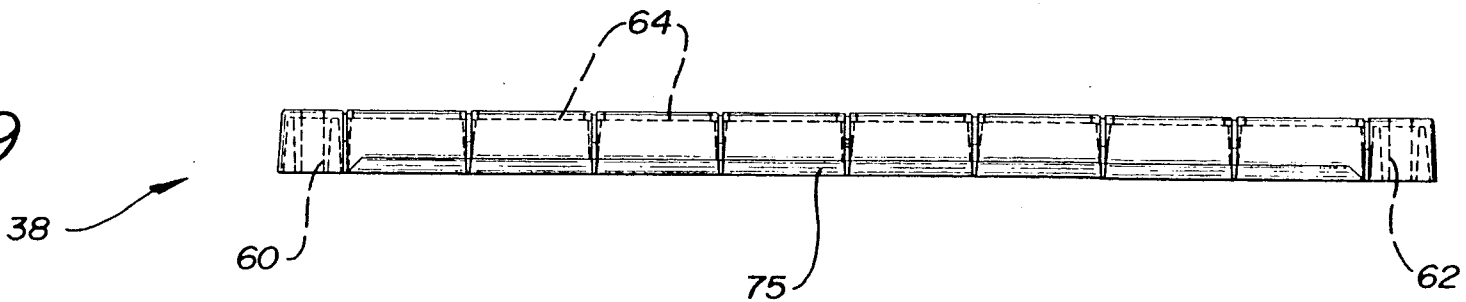
FIG. 9 is a front elevational view of the top step of FIGS. 7 and 8.

FIGS. 7, 8 and 9 show a top view and a rear and front elevational views of top step 38. The top step is provided at opposite edges with a pair of circular holes 60 and 62 which are traversed by respective snap-lock pins 40 (FIGS. 5 and 6) during assembly and installation of side rail assemblies 22 and 24. Step 38, like the other steps, 32, 34 and 36, is further provided with a rectangular array of elongate oval openings 64 for draining water and receiving the flesh of users' feet to increase the hold of the feet on the ladder steps and thereby render the steps slip resistant or foot gripping.

As shown particularly in FIG. 8, top step 38 is formed on an underside with a pair of recesses 66 and 68. These recesses are designed to receive respective wing-like protuberances 70 and 72 on platform 74, shown in top view in FIG. 10, side elevational view in FIG. 11 and front elevational view in FIG. 12.

Inasmuch as steps 32, 34 and 36 are structurally similar to top step 38, except that the three lower steps are not provided with the recesses 66 and 68, separate drawing figures illustrating the lower steps are not included herein. Steps 32, 34 and 36, like top step 38, may all be formed on an underside with a grid-like web structure having criss-crossing support webs (dashed lines 69 in FIG. 7) extending perpendicularly with respect to the plane of the respective step.

Top step 38 is advantageously provided on a forward facing surface 75 with a printed verbal warning "No Jumping—No Diving" or "Do Not Jump—Do Not Dive."

Platform 74 is provided with:

(a) wing-like protuberances 70 and 72 on one side and another pair of wing-like protuberances 76 and 78 on an opposite side for mating with recesses in top steps on opposite sides of A-frame ladder 20;

(b) cylindrical holes 80, 82, 84 and 86 for receiving respective snap-lock pins 40 (FIGS. 5 and 6) to connect the platform to platform guard rails 29 (FIG. 21); and (c) a rectangular array of elongate oval openings 88 for draining water and receiving the flesh of users' feet to increase the hold of the feet on the ladder steps (slip resistant or foot gripping).

Figure 3:
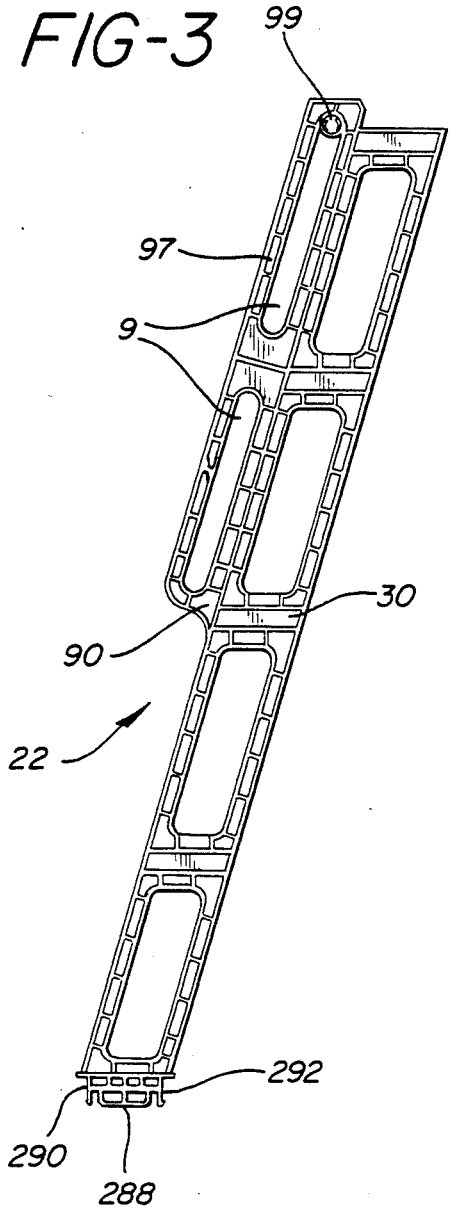
FIGS. 3 and 4 are side elevational views of two staircase subassemblies of the ladder of FIGS. 1 and 2.
Figure 4:
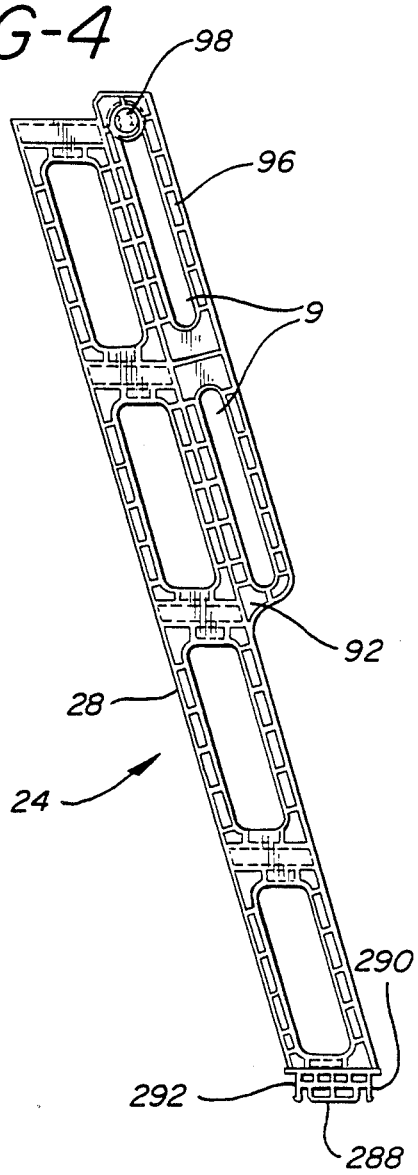

As illustrated in FIGS. 3 and 4, vertical support members 28 and 30 of side rail assemblies 22 and 24 are formed with handrail portions 90 and 92 formed with elongate oval apertures 94 which define relatively thin elongate rail sections 96 and 97. Rail sections 96 and 97 serve as hand grips or hand holds. People using A-frame ladder 20 to climb into or out of an aboveground swimming pool 202 (see FIGS. 18A–18E) can wrap their fingers around rail sections 96 and 97, thereby increasing the safety factor over a ladder which has handrails or side rails without hand grips or hand holds.

Figure 13:
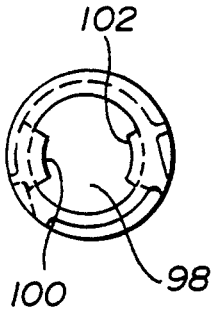
FIG. 13 is a detailed view of a circular opening at an upper end of a handrail portion of the staircase subassemblies of FIGS. 3 and 4.
Figure 14:
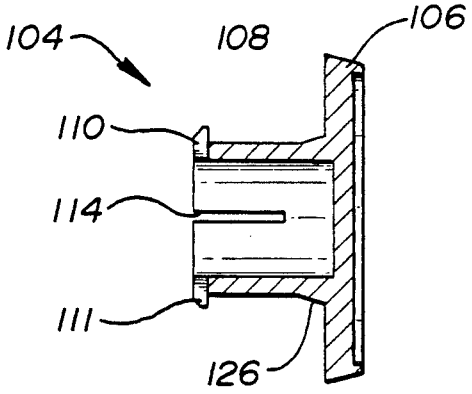
FIG. 14 is a longitudinal cross-sectional view of an interlocking pin member for connecting the staircase subassemblies of FIGS. 3 and 4 to a platform guard rail shown in FIG. 1.
Figure 15:
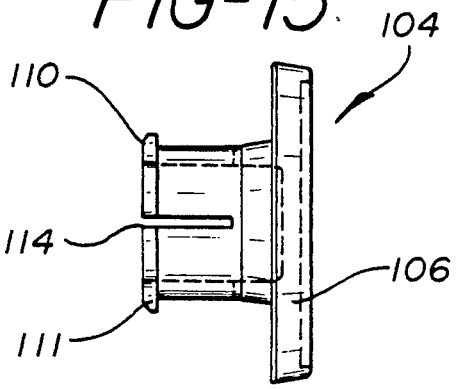
FIG. 15 is a side elevational view of the pin member of FIG. 14.
Figure 16:
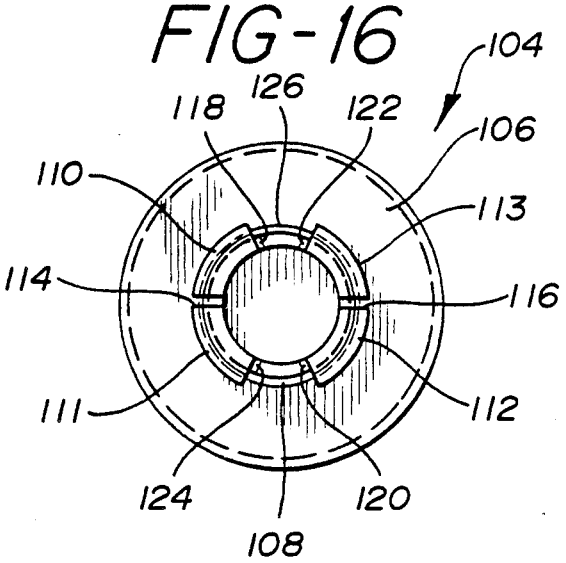
FIG. 16 is a front or rear elevational view of the pin member of FIGS. 14 and 15.
Figure 17:
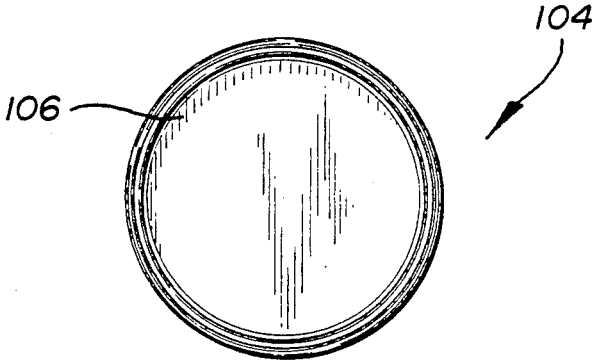
FIG. 17 is a rear or front elevational view of the pin member of FIGS. 14–16.

Handrail portions 90 and 92 are further provided at their upper ends with generally circular openings 98 and 99 each having a pair of diametrically opposed, inwardly directed flanges 100 and 102 (see FIG. 13) in the form of annular sections. Openings 98 and 99 register with circular openings 256 and 254 (FIG. 21) at the bottom of a platform guard rail member 29. The registered pairs of openings receive, during installation of the ladder assembly, particularly during the attachment of side rail assemblies 22 and 24 to platform guard rail assembly 26, respective interlocking pin members 104, one of which is shown in detail in the transverse cross-sectional view of FIG. 14, the side elevational view of FIG. 15, the front elevational view of FIG. 16, and the rear elevational view of FIG. 17.

As illustrated in FIGS. 14–17, each interlocking pin member 104 includes a generally disk-shaped head 106 and a cylindrical shaft 108 formed at a free end, opposite the head, with two pairs of radially outwardly projecting flanges 110, 111, and 112, 113. Cylindrical shaft 108 is further formed with the following:

(a) a pair of diametrically opposed slots 114 and 116 extending longitudinally approximately half the length of the cylindrical shaft;

(b) a first pair of diametrically opposed notches 118 and 120 and a second pair of diametrically opposed notches 122 and 124 flanking the edges of flanges 110 and 112; and (c) an outwardly tapered base 126.

Upon the juxtaposition of a side rail assembly 22 or 24, and particularly a vertical support member 28 or 30 thereof, to one of the two guard rail members 29 so that the opening 98 or 99 in the respective vertical support member registers with the aperture 254 or 256 in the platform guard rail member, an interlocking pin member 104 is inserted through the registered opening and aperture and subsequently turned so that the two juxtaposed ladder members are locked to one another.

FIGS. 18A–18E depict sequential steps in the installation and use of A-frame ladder 20 at an above-ground swimming pool 202. Pool 202 is surmounted by a fence 204 comprising a plurality of fence sections 206. Each fence section 206 may exemplarily comprise a plurality of laterally spaced vertical rods or tubes 208 extending between a pair of horizontal support bars 209 each in turn mounted to consecutive posts 210 of a plurality of such posts circumferentially equispaced from each other in a circular array around an upper rail 211 of a sidewall 212 of pool 202.

Figure 18A:
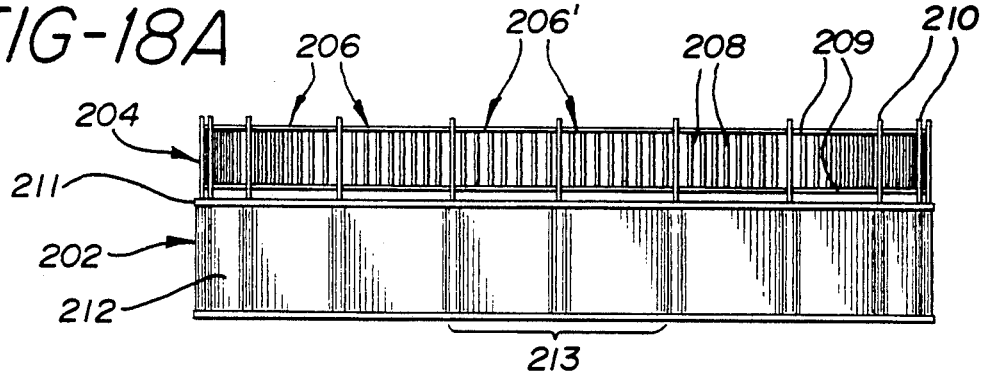
FIGS. 18A through 18E are front elevational views of a swimming pool, showing successive steps in the installation of the ladder assembly of FIG. 1 at a sidewall of the pool.
Figure 18B:
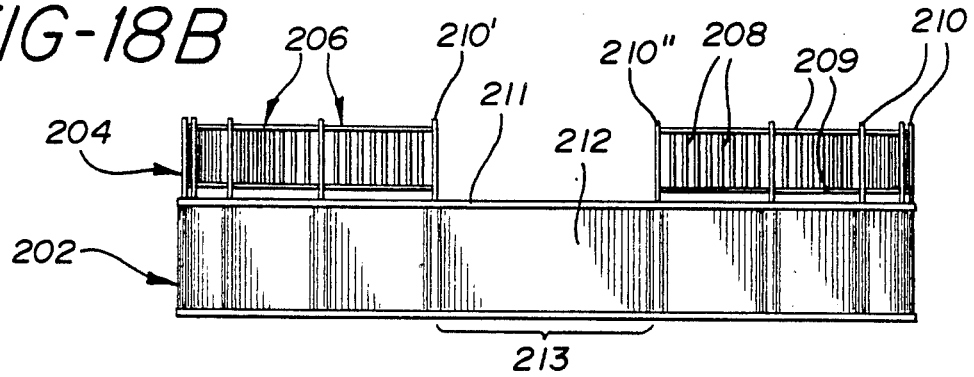
Figure 18C:
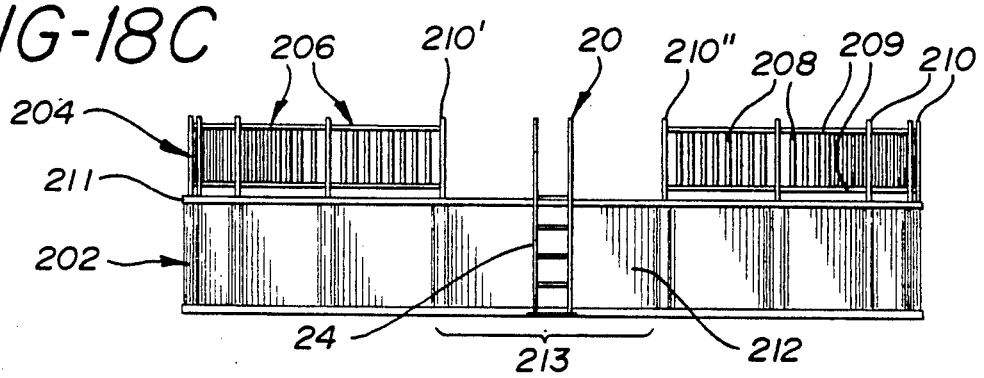

In a first installation step, one or more fence sections 206' are removed to form a gap 213 in fence 204 (FIG. 18B). As indicated in FIG. 18C, A-frame ladder 20 is then placed at the pool so that side rail assemblies 22 and 24 are on opposite sides of pool sidewall 212, with platform 74 and platform guard rail assembly 26 straddling upper rail 211 of sidewall 212.

Figure 18D:
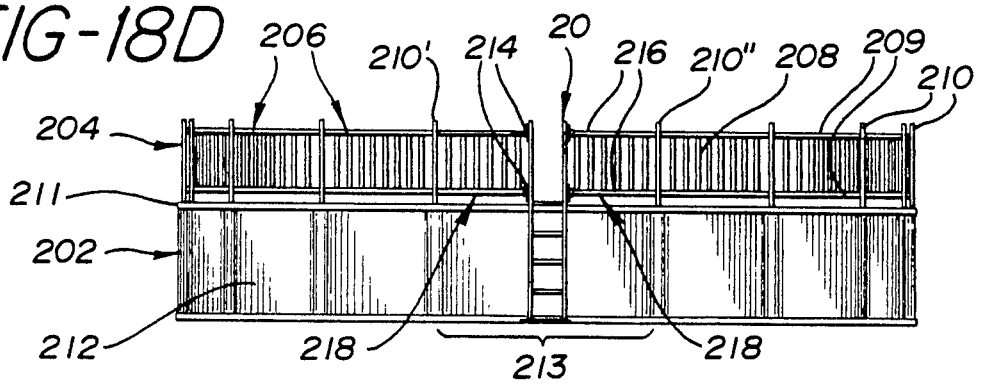
Figure 18E:
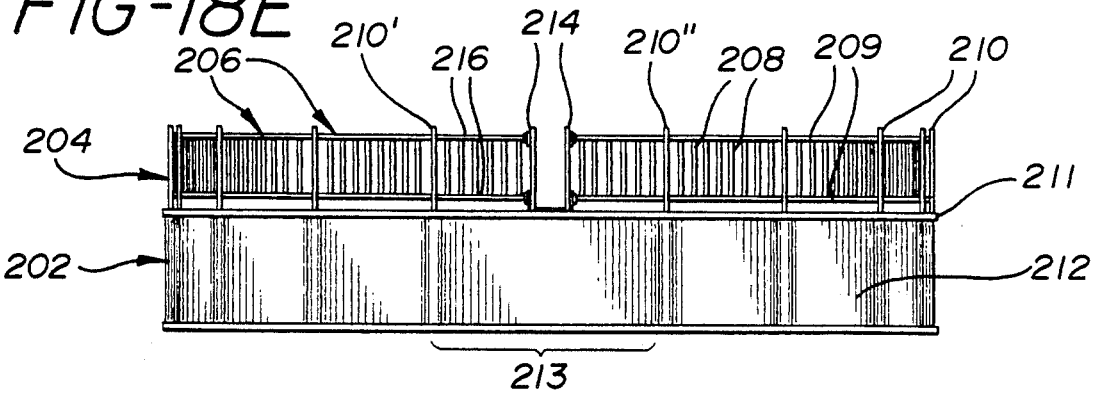

As shown in FIG. 18D, upon the installation of A-frame ladder 20 in the gap created by the removal of fence sections 206', connector brackets 214 (see FIGS. 19, 20) are fastened to the sides of A-frame ladder 20 for receiving the free ends of horizontal support bars 216 of a pair of additional fence sections 218 specially made to fit in the narrow spaces between ladder 20 and posts 210' and 210'' adjacent thereto. As shown in FIGS. 18D and 18E, ladder 20 becomes an integral part of fence 204.

As shown in FIG. 18E, after termination of a period of pool use, side rail assembly 24 (which is disposed outside the pool) is detached from platform 74 and platform guard rail assembly 26 and taken to a storage area such as a garage, whereby it becomes impossible for an intruder or a child to climb into the pool. Side rail assembly 24 is detached by rotating each interlocking pin member 104 through an angle of approximately 90° so that flanges 110–113 (FIGS. 14–16) on the interlocking pin members are angularly disposed in the free spaces between flanges 100 and 102 (FIG. 13) of the holes 98, 99 in the upper ends of rail sections 96, 97 of side rail assembly 24. Upon such rotation of the interlocking pin members 104, they can be removed. The side rail assembly 24 is then lifted and turned and thereby removed.

Figure 19:
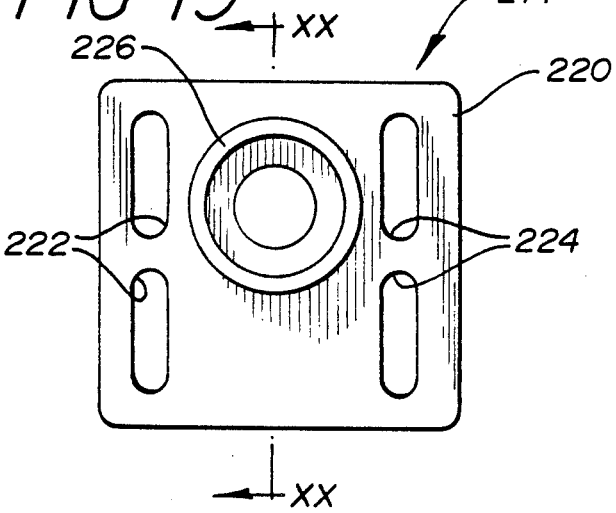
FIG. 19 is a front view, on an enlarged scale, of a connecting bracket shown in FIGS. 18D and 18E.
Figure 20:
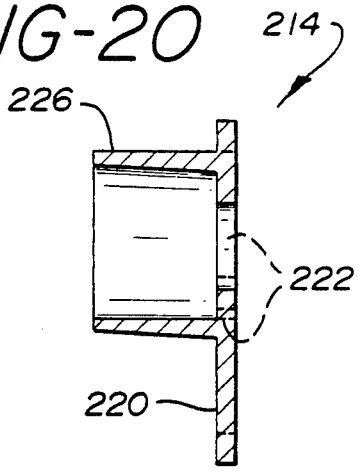
FIG. 20 is a cross-sectional view taken along line XX—XX in FIG. 19.

As depicted in FIGS. 19 and 20, connector brackets 214 each comprise a main body in the form of a mounting plate 220 having a plurality of slots 222 and 224 along opposite edges. Slots 222 and 224 are traversed by respective bolts 228 (see FIG. 1) upon completion of an assembly operation attaching the respective bracket to one of the two guard rail members 29 of platform guard rail assembly 26. Mounting plate 220 also carries an integral collar 226 for receiving a free end of a respective support tube 216 of one of the auxiliary fence sections 218.

FIG. 21 shows in detail a guard rail member 29 of the A-frame ladder 20 of FIGS. 1 and 2. Each guard rail member 29 includes an upper portion 230 in the general form of a downwardly facing C and a pair of leg portions 232 and 234 diverging from upper portion 230. At their upper and their lower ends, leg portions 232 and 234 are connected to one another by upper and lower horizontal cross pieces 236 and 238. An additional, vertically oriented, cross piece 240 extends from a central uppermost point of generally C-shaped upper portion 230 to a central position along lower horizontal cross piece 238. Vertical cross piece or brace 240 intersects upper horizontal cross piece 236 and forms a cross therewith.

Cross pieces 236, 238 and 240 serve to decrease the pass through potential or open air spacing of platform guard rail members 29, thereby reducing the risk of a child falling from platform 74 through the open air spacing between leg portions 232 and 234. Cross pieces 236, 238 and 240 also serve to increase the sight barrier provided by guard rail members 29, thereby rendering A-frame ladder 20 more private.

As shown in FIG. 21, upper portion 230 and leg portions 232 and 234 of each guard rail member 29 are provided with elongate oval apertures 242, 244 and 246 which define relatively thin elongate rail sections 242', 244' and 246' corresponding to rail sections 96 and 97 of side rail assemblies 22 and 24 (FIGS. 3 and 4). As discussed hereinabove, an individual negotiating A-frame ladder 20 can wrap his or her fingers around rail sections 242', 244' and 246', thereby increasing the safety factor over a ladder which has side rails or handrails without hand grips or hand holds.

As is true for the entire ladder design (see FIGS. 1–4), rail sections 242', 244' and 246' each incorporate outwardly, and possibly inwardly, extending flanges or ribs 250 connected by and surrounding thin web areas 252. That design of side rail assemblies 22 and 24, as well as of platform guard rail assembly 26, maximizes the strength of the ladder per unit weight.

Leg portions 232 and 234 are provided at their lower ends with circular apertures 254 and 256 which register with circular openings 98 and 99 in vertical rail or support members 28 and 30 (FIGS. 3 and 4) upon a juxtaposition of a guard rail member 29 with a side rail assembly 22 or 24 during an assembly operation. Upon the registration of an aperture 254 or 256 and an opening 98 or 99, an interlocking pin member 104 is inserted therethrough and rotated to lock the respective guard rail member 29 to the juxtaposed side rail assembly.

Figure 22:
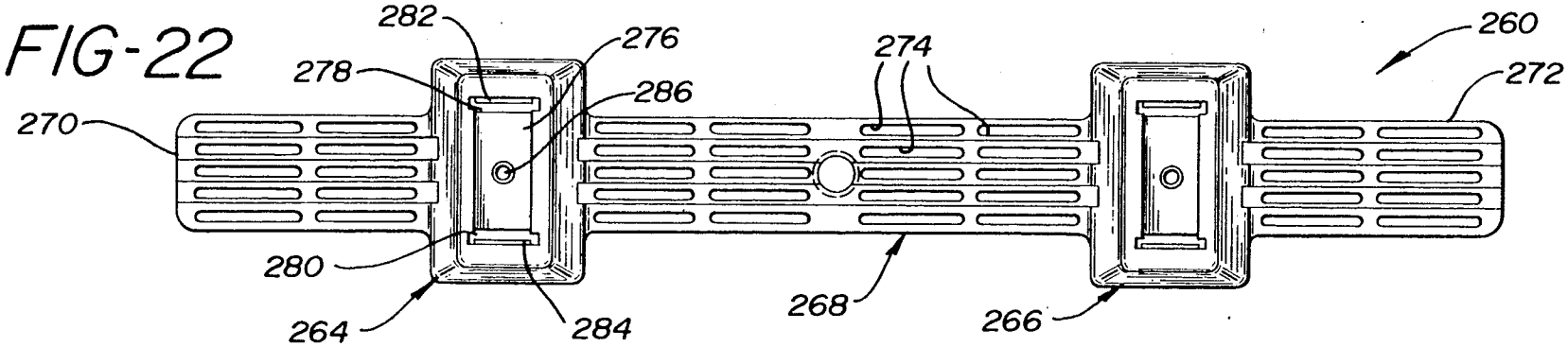
FIG. 22 is top view of a spreader bar included in the A-frame ladder of FIG. 1.
Figure 23:
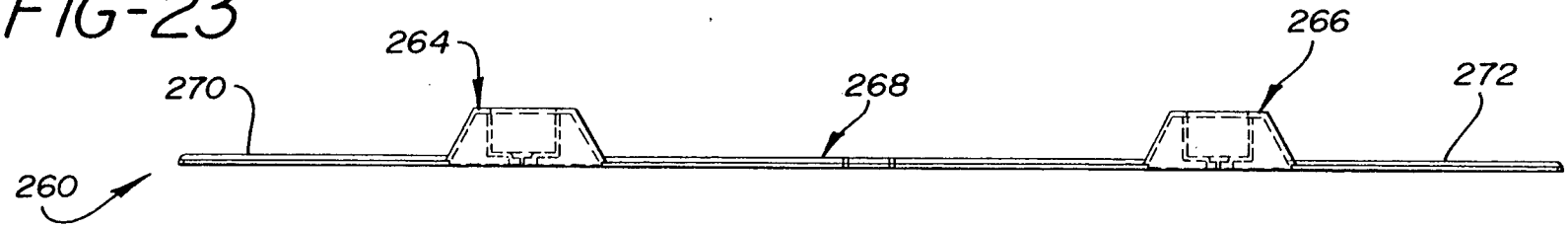
FIG. 23 is a side elevational view of the spreader bar of FIG. 22.
Figure 24:
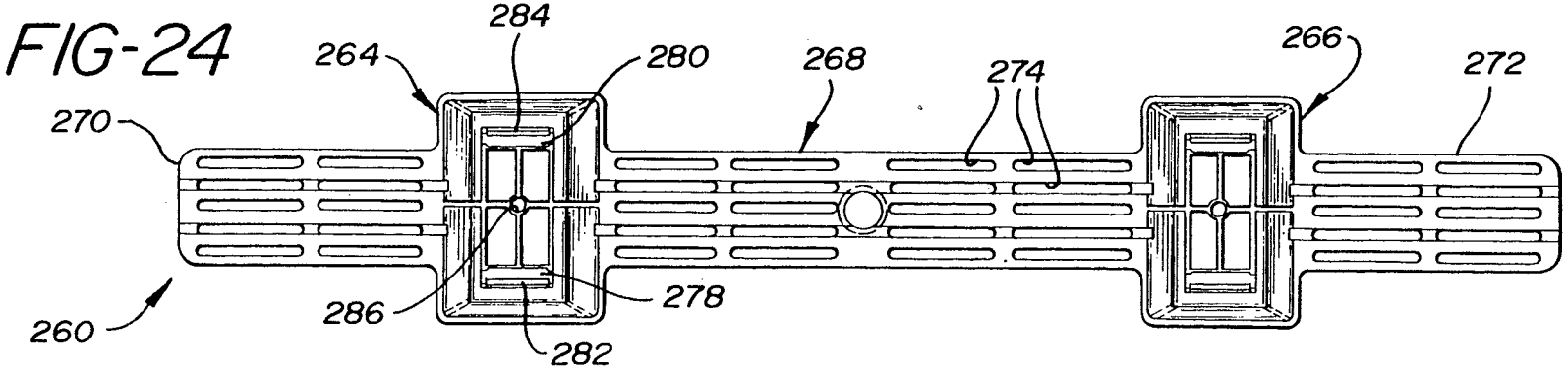
FIG. 24 is a bottom view of the spreader bar of FIGS. 22 and 23.

As shown schematically in FIGS. 1 and 2, A-frame ladder 20 includes a pair of spreader bars 260 and 262 which receive the lower ends of vertical support members 28 and 30 of side rail assemblies 22 and 24 for spacing and supporting the vertical support members, for example, on a grass surface. Each of the two structurally identical spreader bars 260 and 262 (one of which is illustrated in FIGS. 22, 23 and 24) comprises a pair of leg receivers 264 and 266 generally in the form of truncated elongate pyramids joined to one another by a central, substantially plate-shaped connector member 268. On opposite sides of the leg receivers 264 and 266 from the central connector member, the respective spreader bar is provided with a pair of substantially plate-shaped wing extensions 270 and 272 which extend colinearly with respect to one another and to central connector member 268.

Central connector member 268 and extensions 270 and 272 are each formed with a rectangular array of elongate slots or apertures 274 which have dimensions identical to or substantially the same as the dimensions of the elongate oval openings (64) in steps 32, 34, 36 and 38, as well as in platform 74. Like those openings, slots or apertures 274 serve to drain water and to increase the lateral gripping force which the spreader bars exert on users' feet (whereby the spreader bars are slip resistant or foot gripping).

As shown in FIGS. 22–24, leg receivers 264 and 266 each include a central, substantially prismatic recess or receptacle 276 provided at opposite ends with a pair of rectangular slots or openings 278 and 280 oriented parallel to connector member 268 and extensions 270 and 272. Detents in the form of a shallow shoulders 282 and 284 parallel to slots 278 and 280 project inwardly at the slots for facilitating a snap-lock retention of the lower ends of vertical support members 28 and 30.

Each leg receiver 264 and 266 is further provided, in a lower wall defining recess 276, with an opening 286 for receiving a cylindrical projection 288 (shown in FIGS. 3 and 4) at the lower end of a vertical support member 28 or 30. Vertical support members are also formed at their lower ends with a pair of planar projections 290 and 292 on opposite sides of cylindrical projection 294.

A-frame ladder 20 is simply assembled without tools. First, steps 32, 34, 36 and 38 are successively placed in corresponding C-shaped brackets 39 in one of the two vertical support members 28 or 30. Upon such a placement, the respective step is secured to the vertical support member by the insertion of a snap-lock pin 40 through the aligned holes (see holes 60 and 62 in FIGS. 7–9) in the step and the bracket 39.

Upon the attachment of all of the steps to the vertical support members 28 and 30 in the manner described above, thereby forming a side rail assembly 22 or 24, guard rail members 29 are fastened to platform 74 via the use of snap-lock pins or interlocking pins members. The assembled guard rail assembly 26 is then secured to the two side rail assemblies 22 and 24 via interlocking pin members 104. In addition, spreader bars 260 and 262 are connected to side rail assemblies 22 and 24 by first inserting projections 288 into recesses 276 and projections 290 and 292 through slots 278 and 280. Snap-lock pins 40 may then be inserted through openings 296 and corresponding openings (not shown) in a bottom wall of projections 288.

Figure 25:
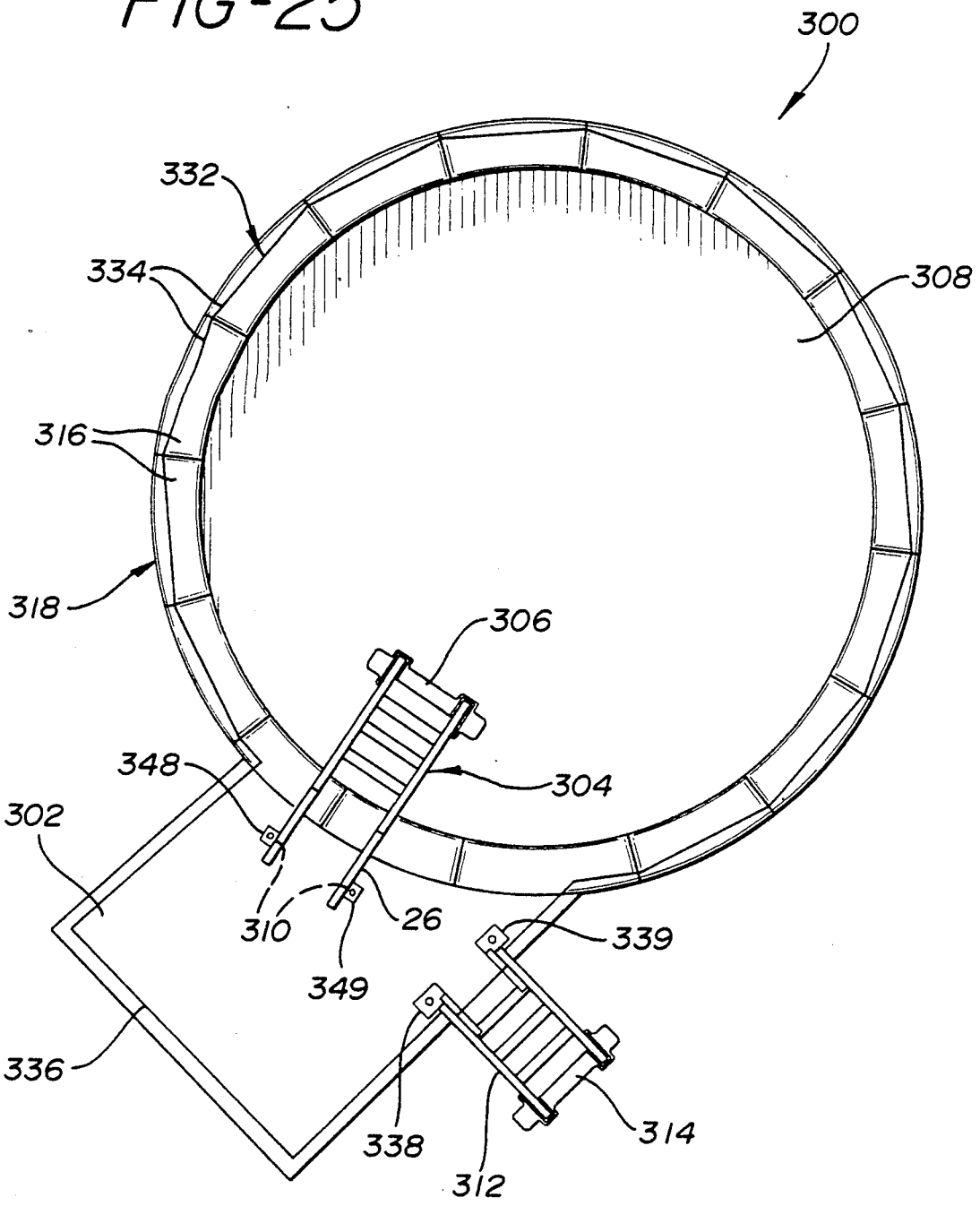
FIG. 25 is a top view of an above-ground swimming pool with an A-frame ladder disassembled into an in-pool ladder and a staircase ladder for use with a pool deck, in accordance with the present invention.

As depicted in FIG. 25, an A-frame ladder in accordance with the present invention may be optionally used with a pool deck 302 attached to the sidewall (not visible in FIG. 25) of an above-ground swimming pool 300. Pursuant to this utilization of ladder 20, platform guard rail assembly 26 remains attached to one of the two side rail assemblies 22 and 24 to form an in-pool ladder 304 which rests with its spreader bar 306 (identical to bars 260 and 262) on a bottom Wall 308 of pool 300. Concomitantly, free ends 310 of platform guard rail assembly 26 are connected to the surface of pool deck 302. The other of the two side rail assemblies 22 and 24 forms a staircase assembly 312 having a spreader bar 314 resting on a ground surface and further having an upper end connected to deck 302.

A-frame ladder 20 is thus alternatively utilizable, pursuant to the invention, either as an A-frame ladder which is placed over the sidewall 212 of a swimming pool 202 (FIGS. 18A-E) or as two swimming pool ladders, namely, an in-pool ladder 304 and a staircase ladder 312. Among other advantages, this alternative usage simplifies inventory accounting procedures by reducing the different kinds of ladders which a retailer must keep in stock.

It is to be noted further that the uses of in-pool ladder 304 and staircase ladder 31, as well as ladder assembly 20, may include non-pool uses about the home. As any A-frame ladder, ladder 20 in particular may be useful to facilitate the painting of ceilings and the hanging of curtains.

As shown in FIG. 25, pool 300 may further include a plurality of top rail members 316 mounted to the pool sidewall to form a continuous perimetral top rail 318. Top rail members 316 may be broad enough so that rail 318 forms a walk-around ledge or deck about the perimeter of pool 300.

Figure 26:
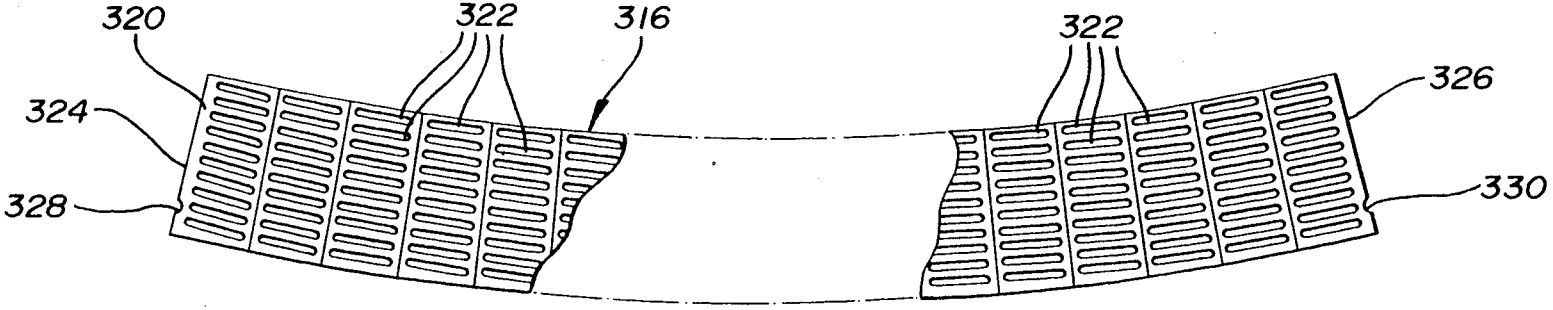
FIG. 26 is a top view, on an enlarged scale, of a top rail section shown in FIG. 25.

As shown in detail in FIG. 26, each top rail member 316 may include a planar main body portion 320 disposed in a substantially horizontal orientation when the rail member has been installed along the top edge of the pool sidewall. Main body portion 320 is advantageously provided with a multiplicity of elongate partially oval apertures 322 arranged in a substantially rectangular but arcuate array, the apertures having a common size and shape identical to or substantially the same as the size and shape of the elongate oval openings (64) in steps 32, 34, 36 and 38, as well as in platform 74. Accordingly, apertures 322 perform the same functions of drainage and gripping as do the apertures in steps 32, 34, 36 and 38, platform 74 and spreader bars 260 and 262. Moreover, owing to the commonality of dimensions and layout of the apertures, the overall design is provided with a uniform aesthetic aspect and appeal. To enhance the aesthetic effect, similar arrays of identical apertures might be formed in vertical bracing members around pool sidewall 212 (see FIGS. 18A-E).

Main body portion 320 of a top rail member 316 may be formed at its transverse edges 324 and 326 with respective notches or cutouts 328 and 330 for receiving bolts or snap-lock pin connectors (not illustrated) for attaching the top rail member along un upper edge of the pool sidewall and/or for receiving vertical bar members of a railing 332. Railing 332 comprises a plurality of individual railing sections 334 which may take a form similar to fence sections 206 (FIGS. 18A–18E) and may interconnect with a railing 336 around deck 302. In addition, in the event that top rail 318 takes the form of a walk-around deck, rail members 316 will be supported by trusswork or brackets in a manner well known to those in the art.

Top rail member 316 is in the form of an arc. However, it is to be noted that the top rail members extending around the rim of a pool sidewall may take on a variety of alternative geometric shapes. For example, the top rail member could alternatively be in the form of a rectangle, a trapezoid or another many sided polygon.

Figure 28:
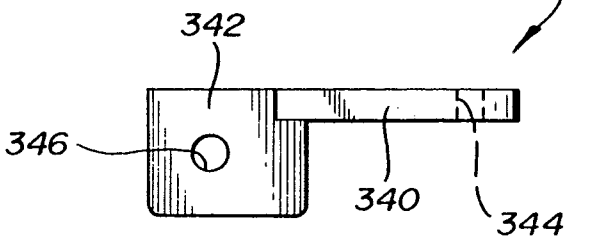
FIG. 28 is a top view of the joiner bar of FIG. 27.
Figure 27:
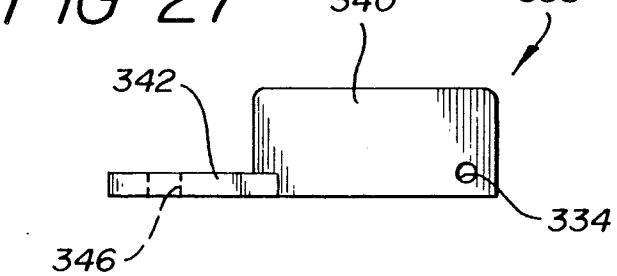
FIG. 27 is a side elevational view of a joiner bar for connecting a portion of the A-frame ladder to a pool deck.

As shown in FIG. 25, the upper ends of vertical support members 22 and 24 of staircase ladder 312 may be connected to pool deck 302 by a pair of mirror-image joiner bars 338 and 339, one (338) of which is illustrated in detail in FIGS. 27 and 28. Joiner bar 338 includes a pair of interconnected planar members 340 and 342 oriented orthogonally with respect to one another. Planar member 340 is provided with an aperture for receiving an interlocking pin member 104, to thereby fasten the joiner bar to the ladder. Planar member 342 is likewise formed with an opening 346 for receiving a bolt member (not illustrated) which may take a form similar to interlocking pin members 104 to lock the joiner bar to pool deck 302.

Figure 29A:
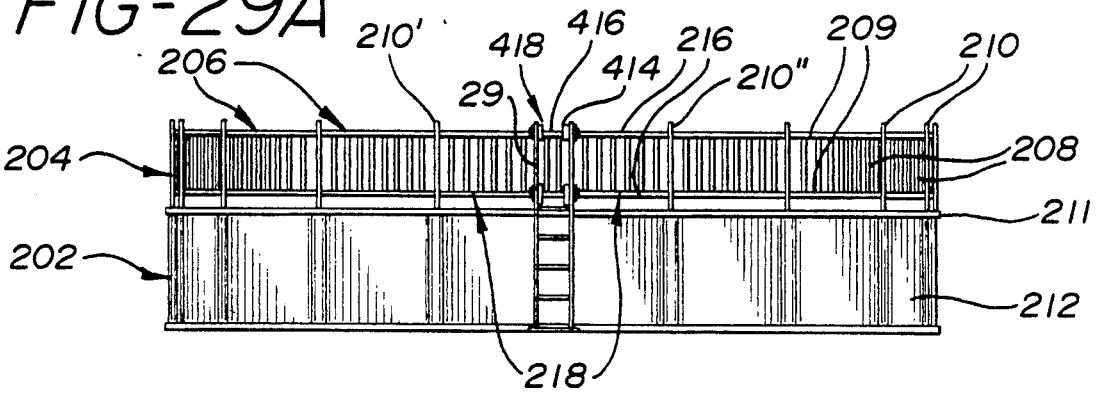
FIGS. 29A and 29B are views similar to those illustrated in FIGS. 18D and 18E and show alternative steps in the use of an A-frame ladder in accordance with the present invention.
Figure 29B:
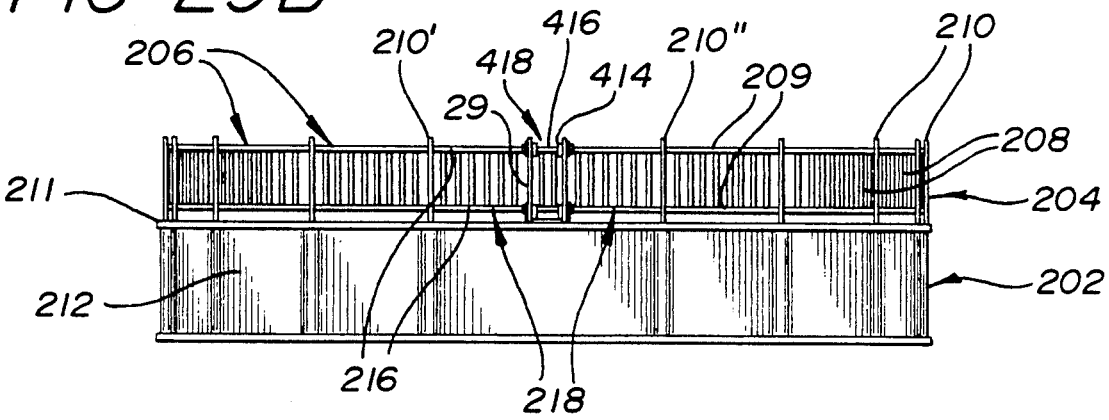

As illustrated in FIGS. 29A and 29B, A-frame ladder 20 may be provided with on the inner sides of platform guard rails 29 with connector brackets 414, which may be identical to brackets 214 (see FIGS. 19, 20) and are fastened to the inner sides of the platform guard rails for receiving the free ends of horizontal support bars 416 of an auxiliary fence section 418 specially made to fit in the narrow space between platform guard rails 29. Upon being connected to guard rails 29, auxiliary fence section 418 becomes, like ladder 20, an integral part of fence 204.

Auxiliary fence section 418 serves to provide additional security in the event that the staircase section of the A-frame ladder is removed. In the event that the staircase section is not removed, whether because of an inability to disconnect the staircase section due to damage to component parts or for some other reason, then auxiliary fence section 414 still serves to inhibit or prevent access to the pool.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are preferred by way of example to facilitate comprehension of the invention and should not be construed to limit the scope thereof.

What is claimed is:

1. An A-frame ladder assembly comprising:

a pair of first side rails;

a pair of second side rails;

a plurality of first steps disposed between and connected to said first side rails;

a plurality of second steps disposed between and connected to said second side rails;

a platform connected to said side rails at upper ends thereof;

a pair of platform guard rails connected to said platform, said side rails and said guard rails being provided With integral handholds.

2. The assembly set forth in claim 1 wherein said side rails and said guard rails are formed with apertures to define and form said hand holds.

3. The assembly set forth in claim 2 wherein said apertures are elongated and arranged in a linear array extending along respective ones of said side rails and said guard rails.

4. The assembly set forth in claim 1 wherein a pair of said side rails and associated ones of said steps form a removable staircase section, further comprising means for removably attaching said staircase section to said platform.

5. The assembly set forth in claim 4 wherein said means for removably attaching includes interlocking projections and recesses on said platform and an uppermost one of the steps of said staircase section.

6. The assembly set forth in claim 5 wherein said projections take the form of flattened wings on said platform.

7. A ladder comprising:

a pair of side rails;

a pair of hand rails each integrally formed with a respective one of said side rails and each formed, along at least a portion of its respective length, with integrally formed handholds; and a plurality of steps extending between said side rails.

8. The ladder defined in claim 7 wherein said hand rails are provided with respective apertures defining said handholds.

9. The ladder defined in claim 7 wherein each of said hand rails is provided with a plurality of elongate apertures disposed in a linear array to define said handholds.

10. The ladder defined in claim 7, wherein the ladder takes the form of a staircase ladder, further comprising attachment means for connecting the ladder at an upper end to a swimming pool deck or, alternatively, a platform of an in-pool ladder section to thereby form with such in-pool ladder section an A-frame ladder.

11. The ladder defined in claim 7, further comprising attachment means for removably connecting the ladder to a platform portion of an in-pool ladder section to form therewith an A-frame ladder.

12. The ladder defined in claim 11 wherein said attachment means comprises mating projections and recesses on the platform portion of the in-pool ladder section and an uppermost step of the ladder.

13. The ladder defined in claim 7 wherein said steps are each provided with a plurality of apertures to form foot gripping surfaces.

14. A ladder assembly disposable inside a swimming pool for enabling climbing access to and from said pool, said ladder assembly comprising:

a pair of side rails integrally formed, along at least a portion of their respective lengths, with respective hand holds;

a plurality of steps extending between said side rails;

a platform connected to said side rails at upper ends thereof; and a pair of platform guard rails connected to said platform and said side rails at the upper ends thereof, said guard rails being integrally formed, along at least a portion of their respective lengths, with respective hand holds.

15. The ladder assembly defined in claim 14, further comprising attachment means for connecting the ladder assembly alternatively to a swimming pool deck and a staircase ladder section.

16. The ladder assembly defined in claim 15 wherein said side rails and said guard rails are provided with respective apertures defining said handholds.

17. The ladder assembly defined in claim 15 wherein each of said side rails is provided with a plurality of elongate apertures disposed in a linear array to define the handholds on said side rails.

18. The ladder assembly defined in claim 14, wherein said attachment means includes means for removably connecting the ladder assembly to a staircase ladder section to form an A-frame ladder assembly.

19. The ladder assembly defined in claim 14 wherein said steps and said platform are provided with respective pluralities of apertures in substantially rectangular arrays to form foot gripping surfaces.

20. The ladder assembly defined in claim 14 wherein said guard rails are provided with means for decreasing pass through potential of said guard rails.

21. The ladder assembly defined in claim 14 wherein said guard rails each include an upper portion in the general form of a downwardly facing C and a pair of leg portions diverging from said upper portion.

22. The ladder assembly defined in claim 21 wherein said guard rails are provided with means for decreasing pass through potential of said guard rails, said means for decreasing including a first cross-piece extending horizontally between lower ends of said upper portion and a second cross-piece extending vertically from a central uppermost point of said upper portion.

23. A ladder assembly disposable inside a swimming pool for enabling climbing access to and from said pool, said ladder assembly comprising:

exactly one pair of planar side rails;

a plurality of steps extending between said side rails;

a platform rigidly connected to said side rails at upper ends thereof;

a pair of platform guard rails connected to said platform and said side rails at the upper ends thereof; and attachment means for connecting the ladder assembly alternatively to a swimming pool deck and a staircase ladder section.

24. An A-frame ladder for enabling access to a swimming pool, comprising:

a staircase section, including an uppermost step;

an in-pool section including a platform;

attachment means for removably connecting said staircase section an an upper end thereof to said in-pool section at said platform, said attachment means including a pair of rotatable pins each provided at one end with an outwardly radially projecting flange having a circumferential extent of less than 360°.

25. The ladder defined in claim 24, further comprising substantially planar projections on said platform and mating recesses on said uppermost step.

26. The ladder defined in claim 24, further comprising additional attachment means for connecting the ladder to a perimetrally extending swimming pool fence.

27. The ladder defined in claim 26 wherein said additional attachment means includes a bracket and means for fastening said bracket to the ladder.

28. An A-frame ladder for enabling access to a swimming pool, comprising:

a staircase section, including an uppermost step;

an in-pool section including a platform;

attachment means for removably connecting said staircase section an an upper end thereof to said in-pool section at said platform;

stabilizing means for stabilizing and strengthening the connection of said staircase section to said in-pool section.

29. The ladder defined in claim 28 wherein said attachment means includes a pair of rotatable pins each provided at one end with an outwardly radially projecting flange having a circumferential extent of less than 350°.

30. The ladder defined in claim 28 wherein said stabilizing means includes substantially planar projections on said platform and mating recesses on said uppermost step.

31. A ladder comprising:

a pair of side rails;

a plurality of steps extending between said side rails; and a pair of snap lock pins connecting each of said steps to said side rails, said snap lock pins extending perpendicularly to the respective step.

32. The ladder defined in claim 31, further comprising a spreader bar with a pair of spaced receptacles receiving bottom ends of said side rails, further comprising additional snap lock pins connecting said side rails to said spreader bar at said receptacles.

33. An A-frame swimming pool ladder comprising:

a pair of staircase assemblies;

a platform connected to said staircase assemblies at upper ends thereof;

a pair of platform guard rail members connected, on opposite sides of said platform, to said platform and said staircase assemblies;

a fence section having a length approximating a distance between said guard rail members; and means for removably connecting said fence section between said guard rail members.

* * * * *

UNITED STATES PATENT AND TRADEMARK OFFICE

CERTIFICATE OF CORRECTION

PATENT NO. : 4,997,061

DATED : March 5, 1991

INVENTOR(S) : Doniel G. Aymes

It is certified that error appears in the above-identified patent and that said Letters Patent is hereby corrected as shown below:

Abstract, line 12, change "twist-ock" to --twist-lock--.

Column 1, line 4, change "to relates" to --relates to--; line 6, change "swimmming" to --swimming--;line 28, change "sWimming" to --swimming--.

Column 4, line 1, change "an" (first occurrence) to --at--.

Column 6, line 55, change "ar" to --are--.

Column 11, line 7, change "Wall" to --wall--; line 59, change "un upper" to --an upper--.

Claim 1, line 12, change "With" to --with--.

Claim 24, line 6, change "an" (first occurrence) to --at--.

Claim 28, line 6, change "an" (first occurrence) to --at--.

Claim 29, line 5, change "350°" to --360°--.

Signed and Sealed this

Twenty-first Day of July, 1992

*Attest:*

DOUGLAS B. COMER

*Attesting Officer*

*Acting Commissioner of Patents and Trademarks*